United States Patent [19]

Janes

[11] Patent Number: 4,989,870

[45] Date of Patent: Feb. 5, 1991

[54] TENNIS RACKET

[75] Inventor: Richard Janes, Belchertown, Mass.

[73] Assignee: Spalding & Evenflo Companies, Inc., Del.

[21] Appl. No.: 463,766

[22] Filed: Jan. 12, 1990

Related U.S. Application Data

[63] Continuation-in-part of Ser. No. 194,617, May 16, 1988, abandoned.

[51] Int. Cl.[5] ..... A63B 49/08

[52] U.S. Cl. ..... 273/73 J; 273/73 D; 273/75; 273/DIG. 8

[58] Field of Search ..... 273/73 R, 73 C, 73 D, 273/73 F, 73 J, 75, 72, 81 R, 81 B, 73 L, DIG. 8, DIG. 23

[56] References Cited

U.S. PATENT DOCUMENTS

| | | | |
|---|---|---|---|
| 3,802,291 | 4/1974 | Young | 273/81 R |
| 3,889,951 | 6/1975 | Schaefer | 273/73 F |
| 4,192,505 | 3/1980 | Tabickman | 273/73 G X |
| 4,261,567 | 4/1981 | Uffindell | 273/81 R |
| 4,284,275 | 8/1981 | Fletcher | 273/DIG. 8 |
| 4,338,270 | 7/1982 | Uffindell | 273/DIG. 8 |
| 4,340,226 | 7/1982 | Haines | 273/DIG. 8 |

FOREIGN PATENT DOCUMENTS

| | | | |
|---|---|---|---|
| 104930 | 4/1984 | European Pat. Off. | 273/73 R |
| 219310 | 4/1987 | European Pat. Off. | 273/73 D |
| 2187392 | 9/1987 | United Kingdom | 273/73 D |

*Primary Examiner*—Edward M. Coven
*Assistant Examiner*—William E. Stoll
*Attorney, Agent, or Firm*—Donald R. Bahr

[57] ABSTRACT

A tennis racket having a graphite fiber containing frame with an opening at the head end constituting a bow and with a handle pallet at the handle end. The handle pallet is formed of a soft, dense, indexable urethane. The bow is formed with a common cross-sectional configuration enlarged in the direction of the axis of the opening and located around the majority of the opening. The racket also includes a grommet strip formed of a soft, durable, wear resistant polyurethane-polycarbonate blend secured to the radially exterior edge of the bow around the majority of the opening.

8 Claims, 3 Drawing Sheets

Fig. 11

| GRAPHITE FRAME DIMENSIONS | | | | SENSATHANE PALLET DIMENSIONS | GRIP DIMENSIONS |
|---|---|---|---|---|---|
| | A | B | C | | |
| P | .760 | .755 | .665 | 1.160 | 1.300 |
| S | 1.020 | 1.000 | 1.100 | 1.330 | 1.470 |
| B | 1.035 | 1.015 | 1.140 | 1.280 | 1.420 |
| P' | .710 | .690 | .835 | .680 | .740 |
| S' | .430 | .450 | .520 | .490 | .520 |
| B' | .220 | .215 | .140 | .470 | .520 |

TENNIS RACKET

RELATED APPLICATION

This application is a Continuation-in-Part of U.S. patent application Ser. No. 07/194,617 filed May 16, 1988, now abandoned.

BACKGROUND OF THE INVENTION

1. Field of the Invention

This invention relates to tennis rackets with improved handle pallets, bows and grommet strips and, more particularly, to an improved tennis racket incorporating a pallet handle which is dense, soft and indexable, which has a durable, soft, wear resistant grommet strip and which has a bow cross-section enlarged in the axial direction.

2. Description of the Background Art

Tennis is considered a sport by some and a game by others. It involves players on opposite sides of a net who employ rackets to strike a resilient ball back and forth over the net. The racket has one end with tensioned strings which contact the ball and another end with a handle grasped by the user.

All players recognize that modern, improved rackets add to their efficiency and enjoyment of tennis. They also believe that further improvements to equipment are still possible for purposes such as abatement of shocks and vibrations when striking the ball, enlargement of that area of the racket face from which superior shots may be hit, better balance of the racket, softer handles which are still indexable, etc.

By way of illustration the background art discloses many types of handles and handle pallets for tennis rackets as well as for other types of hand held devices. To illustrate the wide variety of handle and handle pallets designed for us as tennis rackets, consider the teachings of spiral wound layers as disclosed in U.S. Pat. Nos. 4,015,851 to Pennell and 4,159,115 to Ticktin. Separate sleeves for covering handles are disclosed in U.S. Pat. Nos. 4,098,506 to Gaiser and 3,614,100 to Spitz. Separate sleeves are usually for the purpose of absorbing perspiration. Spector, in U.S. Pat. No. 4,567,091, discloses an adhesive tape usable on handles. In addition, U.S. Pat. Nos. 3,489,031 to Myer; 4,284,275 to Fletcher and 4,660,832 to Shomo, show tennis racket handles designed for particular purposes such as aeration, grip enhancement and for shock and vibration abatement.

In addition to handles and handle pallets specifically designed for utility in tennis rackets, the background art discloses handles designed specifically for use in golf clubs. Note U.S. Pat. Nos. 3,606,325; 4,133,529 and 4,338,270 to Lamkin, Gambino, Uffindell.

U.S. Pat. No. 4,261,567 to Uffindell discloses a grip positionable over the rigid handle end of a golf club or tennis racket. The grip is of a Shore A hardness of 55 to 65. The grip, however, is not a pallet between an octagonal core and grip.

Also within the prior art are those commercial rackets manufactured and sold by the Spalding & Evenflo Companies, Inc. of Tampa, Fl. which are essentially the same in structure as those disclosed and claimed herein except for the pallet material which is hard, with a significantly higher hardness than that disclosed and claimed herein.

Further, the background art discloses many other types of handles for use in a wide variety of applications. These include U.S. Pat. Nos. 3,915,782 to Davis; 4,053,676 to Kaminstein; 4,174,109 to Gaiser; 4,347,280 to Lauand; and 4,373,718 to Schmidt.

Lastly, the background art discloses an even larger number of patents directed to improving grommet strips, bumper strips and bows to which they are to be secured. Consider, for example, U.S. Pat. Nos. 2,552,020 to Tribelhorn; 3,548,484 to Carlton; 3,567,225 to Hollis; 3,582,072 to Stueck; 3,625,512 to Latham; 3,664,668 to Held; 3,664,669 to Latham; 3,702,701 to Vaughn; 2,884,467 to Sommer; 3,889,172 to Vaughn; 3,912,267 to Lyon; 3,930,648 to Brown; 4,005,862 to Portz; 3,066,260 to Rodgers; 4,185,822 to Li; 4,204,481 to Hall; 4,220,335 to Nobbs; 4,314,699 to Bayer; 4,331,331 to Rodgers; 4,429,874 to Rodgers; 4,436,305 to Fernandez and 4,570,933 to Michiels; and in particular 4,496,152 to Mott.

The background art discloses a wide variety of tennis racket features designed to perform a wide variety of functions. They are fabricated of a wide variety of materials, natural and synthetic, and formed by a wide variety of processes. No background art, however, discloses, teaches or suggests a tennis racket with the improved handle pallet, bow and grommet strip as described herein to provide in one unit all of these desirable features, along with greater convenience of manufacture and at a reduced cost. All previous tennis rackets are simply lacking in one regard or another.

As illustrated by the background art, efforts are continuously being made in an attempt to improve tennis rackets. No prior effort, however, suggests the present inventive combination of component elements arranged and configured as disclosed herein. Prior rackets do not provide the benefits attendant with the present invention. The present invention achieves its purposes, objects and advantages over the prior art through a new, useful and unobvious combination of component elements, through the use of a minimum number of functioning parts, through the utilization of readily available materials and conventional components and at a reduction in cost to manufacture.

It is, therefore, an object of the present invention to provide a tennis racket which may have a graphite fiber containing frame with an opening at one end and with a handle pallet at the other end, the handle pallet formed of a soft, dense, indexable urethane; the frame formed with a common cross-sectional configuration enlarged in the direction of the axis of the opening and located around the majority of the opening; and a grommet strip formed of a soft, durable, wear resistant polyurethane-polycarbonate blend and secured to the radially exterior edge of the frame around the majority of the opening.

It is a further object of the present invneiton to enlarge the spot of a tennis racket from which superior shots may be hit.

It is yet a further object of the present invention to increase the comfort of handles of tennis rackets while still maintaining indexability.

Lastly, it is an object of the present invention to provide and maintain better racket balance.

The foregoing has outlined some of the more pertinent objects of the invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a further understanding of the invention may be had by referring to the summary of the invention and the detailed description of the preferred embodiment in addition to the scope of the invention defined by the claims taken in conjunction with the accompanying drawings.

SUMMARY OF THE INVENTION

The present invention is defined by the appended claims with the specific preferred embodiment shown in the attached drawings. For the purpose of summarizing the invention, the invention may be incorporated into a tennis racket which may have a graphite frame with an opening at one end constituting a bow and with an exterior grip and an intermediate handle pallet at the other end. The handle pallet is formed of a soft, dense, indexable, moldable, non-rigid cellular foam material. The bow is formed with a common cross-sectional configuration located around the majority of the bow and enlarged in the direction fo the axis of the bow. A grommet strip is formed of a soft, durable, wear resistant material and secured around the majority of the radially exterior edge of the bow. The handle pallet is molded of a urethane having adurometer of about between 50 and 80 on the Shore A scale, preferably about between 50 and 60 or between 60 and 70 and most preferably of about 65 on the Shore A scale. The cross-section of the bow over the majority of its extent has a radial dimension of about 12 milimeters and an axial dimension of about 20 milimeters plus or minus about 10%. The cross-section of the bow over the majority of its extent has an axial to radial ratio of about between 1.50 and 1.83 to 1, preferable about 1.67 to 1. The grommet strip is molded of a polyurethane-polycarbonate, or other moldable polymeric material, blend having durometer of about between 55 and 59 on a Shore D scale preferable about 57. The radial exterior edge of the bow, over the majority of its extent, is formed with a recess for the receipt of a bumper strip and with radial holes extending through the bow for the receipt of hollow, string-receiving barrels formed as part of the bumper strip. The grommet strip is enlarged axially across the head end of the bow for sontituting a bumper strip. The grommet strip includes string-receiving barrels formed as part of the grommet strip for being received in radial holes extending through the bow.

In addition, the invention may also be incorporaed into a tennis racket having a frame with an opening at the head end constituting a bow and with an exterior grip and an intermediate handle pallet at the handle end. The handle pallet is molded of a soft, dense, indexable urethane having a durometer of about between 50 and 80 on the Shore A scale. The bow is formed with a common cross-sectional configuration enlarged in the direction of the axis of the opening and having a radial dimension of about 12 milimeters and an axial dimension of about 20 milimeters plus or minus about 10%. A grommet strip is molded of a soft, durable, wear resistant polyurethane-polycarbonate, or other similar material, blend having a durometer of about 57 on a Shore D scale plus or minus 5 and secured to the radially exterior edge of the bow around the majority of the opening. The frame is preferably fabricated of graphite reinforced epoxy.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other methods and constructions for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIG. 11 is a chart showing the dimensions of the handle of FIG. 10 including alternate embodiments thereof.

Similar reference characters refer to similar parts throughout the several figures.

DETAILED DESCRIPTION OF THE INVENTION

Figure 1:
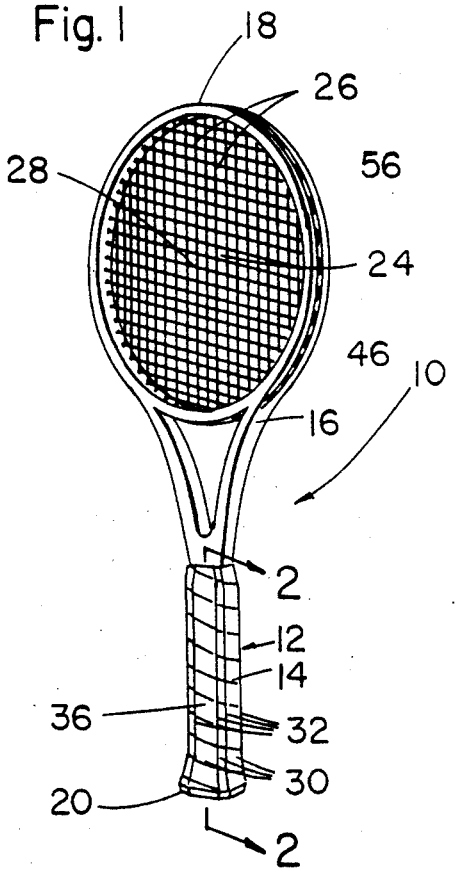
FIG. 1 is a perspective illustration of a tennis racket utilizing the handle and handle pallet of the present invention.
Figure 2:
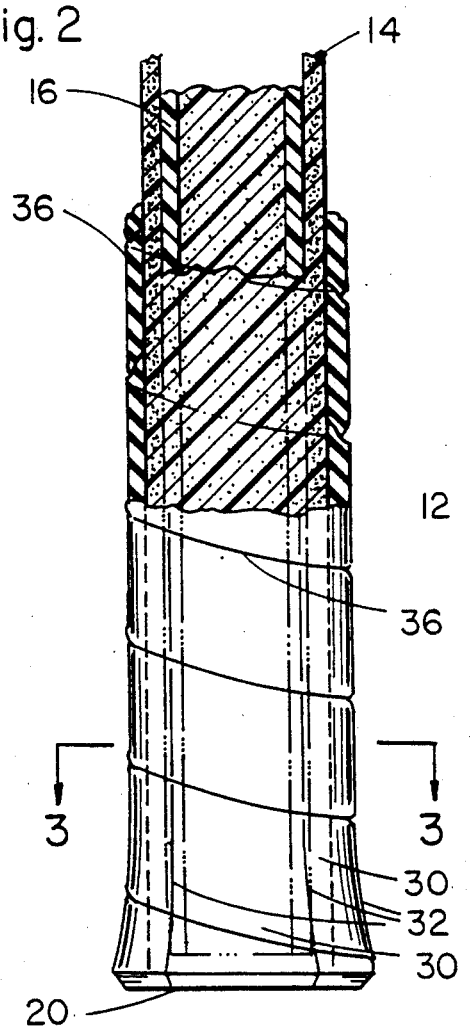
FIG. 2 is a cross-sectional view of the handle and handle pallet of the tennis racket taken along line 2—2 of FIG. 1.
Figure 3:
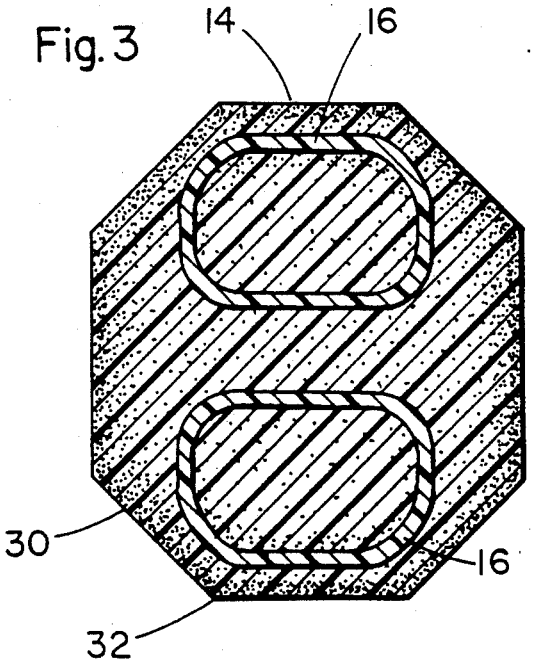
FIG. 3 is a cross-sectional view of the handle and handle pallet taken along line 3—3 of FIG. 2.

Shown in FIG. 1 is what appears to be a conventional tennis racket 10 but which is provided with the improved handle 12 and handle pallet 14 of the present invention. The tennis racket 10 is fabricated of a frame 16 having a head end 18 and a handle end 20. Adjacent the head end 18 is an opening 24 across which strings 26 are secured under tension to constitute the hitting surface 28. Either side of the strings may constitute the hitting surface. Located at the handle end 20 is the handle 12 for being gripped by the user of the racket 10. As is conventional in the art, the handle 12 is provided with a plurality of flat sections 30 extending longitudinally along the handle. Edges 32 separate the flat section 30. In the preferred embodiment, the handle 12 takes an octagonal cross-sectional configuration with eight flat sections 30 and eight edges 32. A spiral wound layer 36, as of leather or the like, covers the handle pallet 14 for improved grippability.

As is the practice in the more modern tennis rackets, the frame 16 is preferably fabricated of some percentage of graphite fibers in the conventional manner. In the past, handles were fabricated of built up components of wood, rubber, plastic, cloth, etc. in various configurations. Spiral wound layers were often utilized. Such a fabrication technique led to irregularities in construction and "feel" from one racket to another and increased rattles during use. The cost of effecting such layering of materials was also found to be excessive. More modern tennis rackets reduced the cost of materials and fabrication and increased their consistency of quality by utilizing a plastic material molded onto the racket frame at the handle end or butt end. Unfortunately, however, such newer handles were always of an excessively hard material, with a Shore D hardness of 40 to 80 plus, whereby forces generated by striking a ball would generate shocks and vibrations which were transferred to the user thereby causing discomfort. Over the course of a game, set or match, such repeated vibrations and shocks would be fatiguing to the user resulting in a continuing decrease in the user's efficiency of play.

The present invention utilizes an elastomeric polymeric material as the handle pallet 14, preferably a urethane, molded to the frame 16 at the butt end or handle end 20. The pallet handle has been found to function with frames, not only of graphite reinforced epoxy, but also of other materials including aluminum and mixtures of graphite reinforced epoxy such as graphite/glass, graphite/Kevlar, graphite/ceramic, or other similar materials utilized as reinforcement fibers in an epoxy matrix. The term "graphite" racket as used herein is intended to include rackets of one-hundred percent (100%) graphite as well as rackets wherein other materials are provided so long as graphite represents a significant amount of the constituent material. The one-hundred percent (100%) graphite racket is preferred.

The exterior surface of the molded urethane is about between 50 and 80 on a Shore A scale. A durometer of either about between 50 and 60 or between 60 and 80 on a Shore A scale is preferred. A durometer of either about 55 or 65 on a Shore A scale is most preferred. The exposed exterior surface as well as the interior surface of the molded pallet form smooth skins of similar characteristics and durometer. The interior region of the foam material which forms the pallet decreases in hardness proportionately with a minimum hardness of about 30 to 70, preferably 65, at its central extent. A urethane of such hardness and molded as described herein has been found to absorb or dampen the shocks and vibrations which would normally occur with handle pallet materials previously known and utilized.

The hardness of this preferred handle pallet material has an added benefit beyond the vibration and shock abatement. Specifically, when such a handle 12 is gripped by a user in a normal fashion during the play of tennis, the user will deform the handle material slightly. Such deformation, however, has been found to be insufficient to effectively eliminate the flat sections 30 and edges 32 molded into the cross-section of the handle. Such flat sections 30 and edges 32 may still be "felt" by the user. As a result, without looking at the racket 10 and its strings 26, the user will be able to "feel" the flat sections and edges and, therefore, be able to index the hitting surface 28 of the racket 10 to a proper angular orientation with respect to the ball to be struck. If a racket with a softer handle pallet were utilized, the user could grasp the handle and effectively obliterate its flat surfaces and edges so that the handle would "feel" like a round cross-sectional handle. In such case, indexing would be impossible.

Handle pallets softer than those of the present invention would result in inferior play by the user. Handle pallets harder than those of the present invention would result in increased fatigue or injury by the user, again resulting in inferior play.

The elastomeric nature of the cells of the urethane allows the handle and handle pallet of the present invention to recover and return to its prior preferred shape after use. The handles and handle pallets of the background art had a rigid cell structure and would tend to retain their new shape after deformation. In prior art rigid cell structures, the individual cells transmit energy in the form of vibration. In the structure of the present invention, the flexible cell structure absorbs the energy effected through ball striking and, hence, such vibrations are not transmitted through to the user for more comfortable and less fatiguing use.

Another feature of the racket of the present invention is that the material of the handle pallet 14 has a higher density than those molded with materials previously known and utilized. Because of this, the weight of prior art handle end 20 is insufficient to maintain the proper weight and balance of the racket 10 between head end 18 and handle end 20. The density of the preferred materials is in a range of about between 8 and 10 pounds per cubic foot. The most preferred density is about 9 pounds per cubic foot. When prior molded handles were utilized, their higher durometer material resulted in a handle 12 of lighter weight. As a result, added weighting components were normally inserted into the handle so that the resulting racket would have better balance between the head end 18 and the handle end 20. When lighter materials were utilized without the added weights, the performance of the user would be inferior due to racket imbalance. While weights could be added to the interior of the handle to correct the problem, such weights often became loose and would shift during play thereby causing "buzzing" and second vibrations. This resulted in even further deterioration in the play of the user. With the denser material of the present invention, the handle 12 can be designed to optimize the balance and "feel" of the racket between bow or head end 18 and the butt or handle end 20 for improved play by the user. The need for weights is thus minimized.

The pallet 14 for the handle 12 of the tennis racket 10 of the instant invention may be molded in any one of several techniques. Two types of molding which have been succcessfully performed include a hand casting and an automatic machine casting. In accordance with the hand cast method, a ratio of 95 parts isocyanate to 100 parts polyol on a weight basis are used. The materials are mixed well and heated to between 110 and 120 degrees Fahrenheit. The materials are then combined in a paper cup and mixed again about between 15 and 20 seconds using a wooden tongue depressor. The mold is charged with about 80 grams of the mixture. The mold is clamped tightly and rotated with the handle end of the frame 16 in proper position within the material. The molded part is then demolded 5 minutes later. Finished parts weighed an average of about 60 and 70 grams now at proper temperature. After sitting for 12 to 18 hours they give a Shore A hardness of about between 50 and 80. The mixing is done with a drill press or with a power mixer, air or electric, in an open cup which gives much more uniform results.

In the automatic machine injection technique, which could also be performed by hand, isocyanate at a pressure of 62 pounds and at a temperature of 120 degrees Fahrenheit is mixed with a polyol at 120 degrees Fahrenheit and at 170 pounds pressure. The materials are combined in a ratio of one part of isocyanate to 1.26 parts polyol at a temperature of between 65 and 80 degrees Fahrenheit. A machine such as an Admiral 122-p low pressure cast machine is utilized. Mold time is 5 minutes with pour time being 1.60 seconds. Cream time is 7.5 seconds, gel time 13.0 seconds, rise time 35.0 econds and tack-free time 80–100 seconds. The free-rinse density is 30 to 31 pounds per cubic foot. The molds are of the epoxy type with any wax-based mold release agent. Such molds may also be fabricated of steel or aluminum. A typical handle pallet weight about between 60 and 70 grams at proper temperature and has a specific gravity of 0.6–0.65 grams per cubic centimeter.

The mixture of polyol and isocyanate is used as the fluid from which the pallet is molded. By adding predetermined amounts of water, e.g., plus or minus 10 percent per 5 gallons of fluid, the Shore A hardness may be decreased or increased to yield the desired pallet characteristics. The hardness could also be varied by other techniques such as varying the molding temperature.

Figure 4:
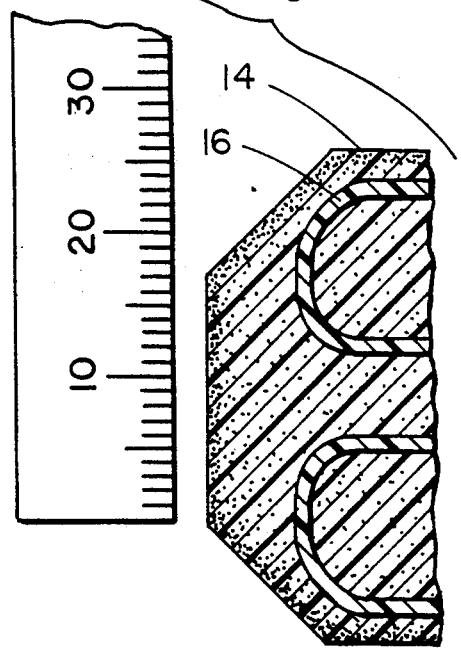
FIG. 4 is an enlarged illustration of a portion of the handle pallet as shown in FIG. 3.

When fabricated as disclosed herein, the molded pallets will form voids with entrapped gasses throughout the polymeric material and thus constitute a foam. Such voids with entrapped gasses will be less extensive at the interior surface contacting the frame and at the exterior exposed surface. The voids with entrapped gasses will be more extensive at the central region of the pallet. Note FIG. 4. The greater the extent of the voids, the less will be the density and hardness. The lesser the extent of the voids, the greater will be the density and hardness. The molded polymeric material of the pallet handle will thus be of uniformly varying density with the greater density being adjacent to its exterior and interior surfaces and the lesser density being adjacent to the central region of the pallet. The greater density at the exterior surface adds to the rigidity and relative hardness of the surface of the handle pallet in the ranges as defined herein to enhance the indexing capabilities of the racket. The greater density and hardness of the pallet adjacent to the frame presents a smooth surface or skin, thinner than the skin of the exposed surface, which maximized contact therebetween. Such an interface facilitates the transfer of vibrations from the frame through the handle to the user for increased absorption of vibrations during use. The interior skin is also tough to preclude wear at this interface over extended use. The lesser density intermediate the surfaces adds to the softness and elasticity of the handle at a location away from the surfaces whereby the absorbing of shock and vibration dampening occurs remote from the player's hand for increased comfort and efficiency.

Figure 5:
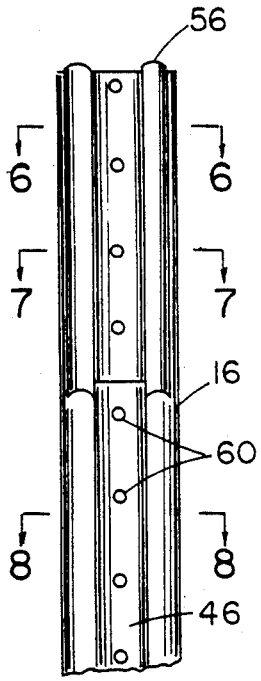
FIG. 5 is an enlarged partial side elevational view of the upper extent of the tennis racket shown in FIGS. 1, 2 and 3 illustrating the frame and grommet strip in greater detail.

As shown in FIG. 5, the cross-sectional configuration of the handle includes, at its center, the two central frame members 16. When oriented side-by-side, the frame members and space therebetween, if any, define a central core 60 which is generally in an octagonal shape. It has parallel side faces P1, end faces S1 and corner faces B1. The core is peripherally surrounded by the handle pallet 14. The pallet also is in the shape of an octagon with parallel side faces P2, end faces S2 and corner faces B2. The pallet is wrapped in the conventional fashion with a strip of skived material in an overlapping relationship to form the grip 36 which is between about 0.058 inches and 0.070 inches in thickness and with a hardness of about between 55 and 80 on a Shore A scale. The grip is essentially conventional in its structure and configuration. It is fabricated of leather or any of the conventional synthetic materials employed for such purpose to approximate the structure and function of leather. Hi-Soft, a commercially available product, has been found to be a suitable material. Hi-Soft is a trademark for a grip material manufactured by Hi Cedar Corporation of Taiwan, Republic of China.

The periphery of the handle, including the core, pallet and grip is nominally about $4\frac{1}{2}$ inches in circumference for the preferred embodiment of the invention. Circumferences from as small as $4\frac{1}{8}$ inches to as large as $4\frac{3}{4}$ inches, including all sizes therebetween, are also common sizes for such circumference and constitute alternate embodiments of the invention.

Figure 6:
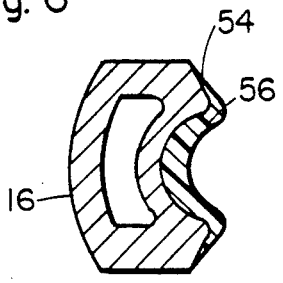
FIG. 6 is a sectional view through the upper extent of the frame and grommet strip shown in FIG. 5 taken between grommet barrels through line 6—6.
Figure 7:
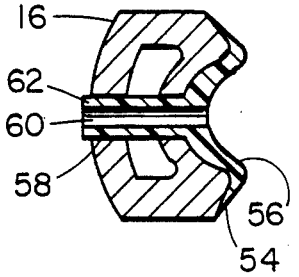
FIG. 7 is a sectional view through the upper extent of the frame and grommet strip shown in FIG. 5 taken through a grommet barrel through line 7—7.
Figure 8:
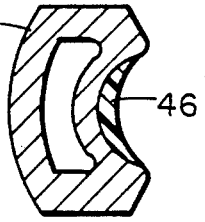
FIG. 8 is a sectional view through the lower extent of the frame and grommet strip shown in FIG. 4 taken between grommet barrels through line 8—8.
Figure 9:
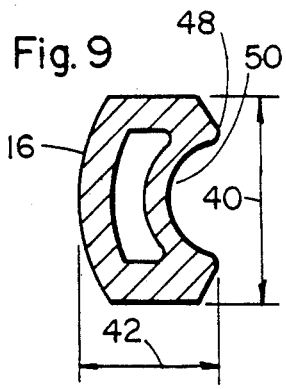
FIG. 9 is a sectional view through the frame and grommet strip shown in FIG. 5 but with the grommet strip removed.
Figure 10:
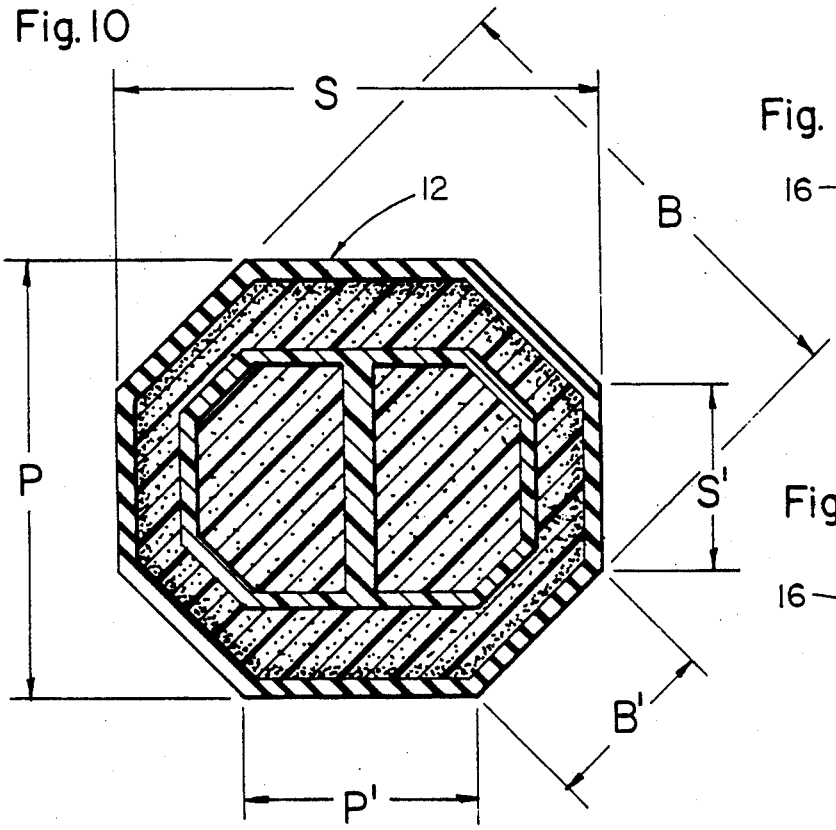
FIG. 10 is an enlarged sectional view of the handle constructed in accordance with the principles of the invention.

The core may be manufactured in any one of several sizes. FIG. 6 designates the dimensions of three frame and core sizes which have been found acceptable. The designations of FIG. 6 correlate to the showing of FIG. 5. Frame or core size C is the preferred embodiment. Frame sizes A and B constitute alternate embodiments of the invention. Any of the three frame sizes may be used in association with any of the pallet sizes. The grip material is of equal thickness for any of the pallet or handle sizes. The pallet sizes for the different handle sizes change proportionately with respect to the FIG. 5 showing and associated FIG. 6 numbers.

Considering the primary embodiment of the invention, the $4\frac{1}{2}$ inch handle with the C core, the pallet constitutes about 43.8 percent of the area of the entire handle, grip included. When cores A and B are utilized with such handle, the area of the pallets constitutes 43.5 percent and 44.5 percent respectively of the area of the entire handle.

The thickness of the pallet material at the side faces is between about 0.200 and 0.248 inches for the various embodiments of the $4\frac{1}{2}$ inch handles. The thickness of the pallet material at the corner faces is between about 0.070 and 0.132 inches for the various embodiments. The thickness of the pallet material at the end faces is between about 0.115 and 0.165 inches for the various embodiments.

When cores A and B are utilized with the smallest and largest handle sizes of the alternate embodiments, the area of the pallets constitutes 40.8 percent and 55.4 percent respectively of the area of the entire handle. The pallet material thicknesses at the side faces range from 0.140 to 0.266 inches, at the end faces range from 0.046 to 0.186 inches, and at the corner faces range from 0.004 to 0.153 inches.

The hardness of the pallet is between 50 and 80 on a Shore A hardness scale. It has been found that for the traditional player who is used to well defined edges due to many years of play relying on the indexing which prior hard pallets provided, a Shore A hardness of between 60 and 80 is preferred for increased feel for indexing. Specifically, a Shore A hardness of between 60 and 70 is more preferred, most preferably about 65. For the players who still rely on indexing but are not as tied to the feel of past rackets with hard pallets, a Shore A hardness of between about 50 to 60 is preferred. This will allow for good indexing but minimizes the effects of shock and vibration to the player during use. The pallet with the Shore A hardness of between about 50 and 60 is also preferred by teaching pros where they play day in and day out. A Shore A hardness range of between 52 and 58 is more preferred, most preferably about 55.

Another aspect of the tennis racket of the instant invention is the fact that the bow 18 at the upper extent of the racket, that portion remote from the handle 20, may be made much thicker than previously for stiffening purposes. By thicker it is meant an increase in that dimension 40 of the racket measured along the axis of the opening.

It should be noted that many rackets in the past, and those of lesser quality, were made of a thick cross-section. In top quality rackets, however, the upper extents of the rackets were not thick. If they were thick, severe vibrations would be set up in the racket if the ball were struck away from the center of the strings in the opening, particularly if struck in the upper extent of the head.

It should be appreciated that the upper extent of the bow or head represents one section of the racket where it is undesirable to strike the ball. Generally, the upper extent of the bow is an anti-nodal area so that if a ball were struck there, adverse vibrations would be set up.

The center of a racket head is called the "sweet" spot because it is the nodal part of the racket. If a ball is struck there, minimum vibrations are set up and a superior shot is made. With a thicker head as described herein, it is possible to strike a ball in the upper section without adverse vibrations being set up. As such, there is an increase in the area of the stringed face of the racket where superior shots may be hit. The problem arising with hitting the ball off center, that is, near the lateral outer extents or the lower or upper extents of the bow, those areas away from the center, has been inherent in rackets since the inception of the game with wooden rackets many years ago.

The larger-than-conventional bow cross-section surrounding the major extent of the opening has enabled a distinct improvement in play as well as greater enjoyment with a racket similar in most other respects to conventional and standard rackets used today. The increased front to back thickness, axially with respect to the opening, measured at its greatest extent, has increased from the normal 17 milimeters (0.670 inches) to 20 milimeters (0.787 inches). The radial thickness 42, radially with respect to the opening, measured at its greatest extent, remains the same at 12 milimeters (0.472 inches). The cross-section of the bow, over the majority of the extent, has a radial dimension of about 12 milimeters and an axial dimension of about 20 milimeters plus or minus about 10% which represents an axial to radial ratio of about between 1.50 and 1.83 to 1, preferably about 1.67 to 1.

This change of dimension has increased the playability as a whole especially in the upper head area due to increased geometric strength. All previous frames of reduced cross-sectional size were used as a method of compensating for too much shock transmission with stiffer material and geometry. This is the first application of this enlarged bow cross-section in the use of graphite fiber for the purpose of creating a new racket with superior plying characteristics, increase in straight line head stiffness and also torsional stiffness. It has the effect of eliminating dead spots away from the center of the head. Ancillary vibrations during the ball impact are dramatically reduced due to higher hoop strength so the hit of any ball is especially clean and powerful over an enlarged area of the face without the usual static vibrations. The usual expected high shock transmission is not present due to the shock absorbency of both the grommet strip and handle pallet.

The final feature of the racket is the soft grommet strip 46 which further absorbs and abates shocks as well as vibrations before they are transmitted from the strings to the bow to the handle to the player. The shape of the grommet strip is essentially conventional. It extends over the top of the bow on the radially exterior edge 48 thereof and encompases the majority of the extent of the bow opening. It confirms in cross-sectional shape to a recess 50 in the exterior edge of the bow and extends to a limited distance radially outwardly therefrom. The portion of the grommet strip extending across the top of the bow has enlarged axially extending portions 54 functioning as a bumper strip 56 to preclude inadvertent scratching of the bow in this region. String-receiving barrels 58, fabricated as extensions of the bumper strips 56 and with radial holes 60 extending therethrough, function as grommets and are preferably formed directly with the grommet strip. As such, the hardness and other physical characteristics of the grommets and bumper strips are matched. These barrels extend through aligned radial holes 62 in the bow and function to support the strings.

The soft grommet strip is in the order of 57 Shore D scale plus or minus 5, i.e., from about between 52 and 62. In this regard, prior art grommet strips were manufactured from various thermoplastic materials but they never had a Shore hardness of about 57 in order to achieve the desired results of this invention.

The above referred-to patent to Mott discloses a racket with a soft bumper strip. Such strip, however, is in a squash, not tennis, racket. Further, the strings do not pass therethrough for shock and vibration abatement during play.

A preferred grommet strip material is pelletized thermoplastic polyurethane-polycarbonate blend. Texin 3203, a commercial product of Mobay Corporation of Pittsburgh, Pa. has been found to be highly suitable. Such resin was supplemented in the conventional manner with appropriate minor quantities of ultraviolet (UV) stabilizers and antioxidants to improve life and performance. The resin was molded in a conventional injection molding machine. The pellets were dried at 220 degrees Fahrenheit for at least two hours. An injection pressure of 8,000 to 15,000 psi and a holding pressure of 5,000 to 10,000 psi were utilized. Mold temperature was 80 to 120 degrees Fahrenheit. Cycle time was 20 to 60 seconds, and injection time was 5 to 10 seconds. The screw speed was 20 to 40 rpm with a screw back presure of below 200 psi. Dry fluorocarbon was the mold release material. The clamping pressure was 3 to 5 tons per square inch of projected part area. The injection molding temperature for typical profile in degrees Fahrenheit were: rear zone (400 to 420), center zone (400 to 420), front zone (410 to 430), nozzle (420 to 440), melt (430 to 450).

In selecting a material with the desired Shore hardness for a grommet strip and grommets, the material cannot be so soft that the strings bite through the grommet strip when it is put under pressure in the racket.

Tensions are generated on rackets from 40 to 80 pounds. Eighty pounds is an upper limit. It has been found that the hardness range mentioned above from 52 to 62 is hard enough to keep the strings from biting or tugging through the grommet strip at all normal stringing tension. It is intended to create a Shore hardness in the grommet strip that is just soft enough to allow the strings to slightly bit einto without cutting through excesively to thereby give excellent shock and vibrational dampening properties.

The composition for the grommet strip, as mentioned above, is also advantageous in that it has an excellent memory. When a racket is strung, the grommet strip is deformed. The excellent memory is advantageous in that when the strings are cut and removed, the grommet stirp tends to go back to its original shape and, hence, can be removed. If a grommet strip does not go back to its original shape, if, for example, the flared ends remain flared, in many cases the grommet strip can only be removed with great difficulty.

Further, the grommet strip as mentioned above has high tear strength. High tear strengths are important in that when an individual is attempting to remove the grommet strips for restringing, it is important that the grommet strip does not tear apart, thereby subjecting the strings to the sharp edges of the frame holes, as well as the separation of the grommet barrels during removal of the strings from the barrels. The removal of prior art type grommet strip components from the racket frame was, and still is, very difficult and expensive.

Since there are two types of vibrations which can be transmitted and/or dampened by the grommet strip, any vibration or shock imparted to the string will be dampened by its contact with the soft grommet strip. In modern composite rackets there is still a second type of vibration which occurs when the string just separates contact with the grommet on the interface of the racket. With a hard grommet strip a player tends to get a buzzing between the innermost face of the grommet strip and the string where it leaves the grommet. Because the grommet strip in question is softer than normal, it seems to absorb the shocks and vibrations at this point. The vibration where the string leaves the grommet is called buzzing and is very prevalent in modern composite rackets.

The physical properties for the grommet strip, as mentioned above, are also important if you have a grommet strip which is a combination of a grommet strip and a bumper strip. It is important to have a high tear strength when the grommet strip also functions as a bumper strip as racket heads often impact the ground during play. When the racket head impacts the ground at high velocity, if the grommet strip does not have a high tear resistance, chunks of the grommet strips tend to be torn away by the impact. This has been a problem of prior art grommet strips. The grommet strip of the present invention has a high impact or tear resistance, hence, if the racket head strikes the ground, the grommet combination with the bumper strip tends to maintain the structural integrity of the racket and grommet/-bumper strip and chunks are not torn out.

The bumper/grommet strip of the present invention employs moldable urethane, or other similar material, as the material of choice for injection molded bumpers and grommet strips for rackets. A composite of various materials may be used, combining urethane with other materials to achieve the desired characteristics. The preferred material is polyrethane-polycarbonate blends. Other molding techniques may be employed if more advantageous than injection molding. The usual material of choice for grommet strips presently is nylon. Urethane has much higher abrasion resistance and tear strength than nylon and may be used in combinations of bumper with grommets as well as in grommets alone. Urethane is softer than nylon and thus cushions the strings more, thus leading to superior shots over a larger ball-striking area with less vibration and shock on the ball impact, as well as quieter hits with the elimination of the string buzzing against the grommets.

By using the combination of a thicker head, with softer grommet strip, and with the soft pallet handle as described above, shocks and vibrations are dampened to a point that they are acceptable, off center hits are possible and functional, the gripping and balance of the racket is improved, all for superior play and greater enjoyment by the player.

Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described, what is claimed is:

1. A tennis racket comprising a frame with an opening at the head end consisting of a bow and with a handle at the opposite end, the frame being fabricated of a rigid material, the handle including a separate intermediate member on the rigid frame with an exterior cross-sectional configuration having a plurality of flat sections and edges extending along the length thereof and an interior configuration conforming to the frame, the intermediate member being molded of a dense, soft urethane having a durometer at its exterior surface of about between 50 and 80 on the Shore A scale, the intermediate member having a common cross-sectional configuration along the majority of its length but varying in thickness around its circumference, the handle further including a separate soft grip material wrapped around the exterior of the intermediate member, the bow being formed with a common cross-sectional configuration enlarged in the direction of the axis of the opening and located around the majority of the opening and having a radial dimension of about 12 milimeters plus or minus about 10% and an axial dimension of about 20 millimeters plus or minus about 10%; and a grommet strip being molded of a soft, durable, wear resistant polyurethane-polycarbonate blend having a durometer of about 57 on a Shore D scale plus or minus 5 and secured to the radially exterior edge of the bow around the majority of the opening.

2. The tennis racket as set forth in claim 1 wherein the cross-section of the bow over the majority of its extent has an axial to radial ratio of about between 1.50 and 1.83 to 1.

3. The tennis racket as set forth in claim 1 wherein the cross-section of the bow over the majority of its extent has an axial to radial ratio of about 1.67 to 1.

4. The tennis racket as set forth in claim 1 wherein the grommet strip is molded of a polyurethane-polycarbonate blend having a durometer of about between 52 and 62 on a Shore D scale.

5. The tennis racket as set forth in claim 1 wherein the grommet strip is molded of a polyurethane-polycarbonate blend having a durometer of about 57 on a Shore D scale.

6. The tennis racket as set forth in claim 1 wherein the radial exterior edge of the bow, over the majority of its extent, is formed with a recess for the receipt of a bumper strip and with radial holes extending through the bow for the receipt of hollow, string-receiving barrels formed as part of the bumper strip.

7. The tennis racket as set forth in claim 1 wherein the grommet strip is enlarged axially across the head end of the bow for constituting a bumper strip.

8. The tennis racket as set forth in claim 1 wherein the grommet strip includes string-receiving barrels formed as part of the grommet strip for being received in radial holes extending through the bow.

* * * * *